US007850290B2

(12) United States Patent
Nitta et al.

(10) Patent No.: US 7,850,290 B2
(45) Date of Patent: Dec. 14, 2010

(54) INK JET RECORDING APPARATUS, INK SUPPLYING MECHANISM AND INK SUPPLYING METHOD

(75) Inventors: Noboru Nitta, Tagata-gun (JP); Masashi Shimosato, Izunokuni (JP); Hideaki Nishida, Izunokuni (JP); Isao Suzuki, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 607 days.

(21) Appl. No.: 11/617,036

(22) Filed: Dec. 28, 2006

(65) Prior Publication Data

US 2008/0158320 A1 Jul. 3, 2008

(51) Int. Cl.
*B41J 2/175* (2006.01)

(52) U.S. Cl. ..... 347/85; 347/89

(58) Field of Classification Search ..... 347/7, 347/84, 85, 89

See application file for complete search history.

(56) References Cited

U.S. PATENT DOCUMENTS

| | | | | |
|---|---|---|---|---|
| 5,220,345 | A * | 6/1993 | Hirosawa | 347/17 |
| 5,943,078 | A * | 8/1999 | Nishimoto et al. | 347/89 |
| 6,082,851 | A * | 7/2000 | Shihoh et al. | 347/85 |
| 6,443,560 | B1 * | 9/2002 | Okano et al. | 347/55 |
| 7,044,579 | B2 | 5/2006 | Katsuumi | |
| 7,399,075 | B2 * | 7/2008 | Nomura et al. | 347/89 |
| 2002/0118256 | A1 | 8/2002 | Dixon et al. | |
| 2005/0007399 | A1 | 1/2005 | Harvey et al. | |

FOREIGN PATENT DOCUMENTS

| | | |
|---|---|---|
| JP | 10-114081 | 5/1998 |
| JP | 10315491 | 12/1998 |
| JP | 2000-289222 | 10/2000 |
| JP | 2005-161633 | 6/2005 |
| JP | 2006-175651 | 7/2006 |
| WO | 2006030235 | 3/2006 |
| WO | 2006064036 | 6/2006 |
| WO | 2006064040 | 6/2006 |
| WO | 2006064043 | 6/2006 |

OTHER PUBLICATIONS

Chinese Office Action dated May 15, 2009, corresponding to U.S. Appl. No. 11/617,036, filed Dec. 28, 2006.

* cited by examiner

*Primary Examiner*—Anh T. N. Vo
(74) *Attorney, Agent, or Firm*—Turocy & Watson, LLP

(57) ABSTRACT

An ink jet recording apparatus includes an ink jet head having a pressure chamber opposed to a nozzle, an upstream port that communicates with the pressure chamber, and a downstream port, a first tank that communicates with the ink jet head via the downstream port and is capable of storing an ink, a second tank that communicates with the first tank and is capable of storing the ink, a third tank that communicates with the ink jet head via the upstream port and communicates with the second tank and is capable of storing the ink, an opening and closing mechanism that is capable of opening and closing a circulation path that connects the ink jet head, the first tank, the second tank, and the third tank, and an air pressure adjusting mechanism that is capable of adjusting an internal air pressure in at least one of the first tank, the second tank, and the third tank. The ink is fed through the circulation path according to an air pressure generated by adjustment of the air pressure and an opening and closing state of the circulation path.

11 Claims, 5 Drawing Sheets

| Operation | 25S | 40S | 52V | 53V | 54V | 34/35 | 44/45 |
|---|---|---|---|---|---|---|---|
| Circulation | Lower | Upper | ○ | × | × | Atmosphere | Medium |
| Circulation/Filling of positive pressure tank | Lower | Lower | ○ | × | ○ | High | Medium |
| Circulation/Control of liquid surface of meniscus pressure tank | Upper | Upper | ○ | ○ | × | Atmosphere | Medium |
| Circulation/Control of liquid surface of meniscus pressure tank | Upper | Lower | ○ | ○ | × | Atmosphere | Medium |
| First purge operation | | | × | × | ○ | High | Medium |
| Second purge operation | | | × | × | × | Atmosphere | High |

FIG. 4

INK JET RECORDING APPARATUS, INK SUPPLYING MECHANISM AND INK SUPPLYING METHOD

BACKGROUND OF THE INVENTION

1. Field of the Invention

The present invention relates to an ink jet recording apparatus that circulates an ink and ejects the ink from an ink jet head and an ink supplying mechanism and an ink supplying method for supplying the ink in the ink jet recording apparatus.

2. Description of the Related Art

A technique for ejecting an ink from a nozzle of an ink jet head while circulating the ink in an ink jet recording apparatus is disclosed in, for example, JP-T-2002-533247 (the term "JP-T" as used herein means a published Japanese translation of a PCT patent application) or US 2002/0118256A1. In such an ink jet recording apparatus, a liquid surface of an upstream side tank is kept constant. An ink in the upstream side tank flows into a printing head through an upstream side channel of the printing head and flows into a downstream side tank through the printing head and through a downstream side channel. A liquid surface of the downstream side tank is kept constant. A circulating pump is provided in a circulation path. The circulating pump pumps up the ink from the downstream side tank, cause the ink to pass a filter, and pumps up the ink to the upstream side tank through a feedback channel. The circulating pump has a function of directly coming into contact with the ink and feeding the ink to circulate along a predetermined circulation path. Therefore, for example, the circulating pump is required to keep chemical stability against the ink, not to cause dust, and to less easily cause foaming. However, it is extremely difficult to realize a pump that satisfies these requirements and has high reliability and durability.

BRIEF SUMMARY OF THE INVENTION

According to an aspect of the invention, there is provided an ink jet recording apparatus including an ink jet head having a pressure chamber opposed to a nozzle, an upstream port that communicates with the pressure chamber, and a downstream port, a first tank that communicates with the ink jet head via the downstream port and is capable of storing an ink, a second tank that communicates with the first tank and is capable of storing the ink, a third tank that communicates with the ink jet head via the upstream port and communicates with the second tank and is capable of storing the ink, an opening and closing mechanism that is capable of opening and closing a circulation path that connects the ink jet head, the first tank, the second tank, and the third tank, and an air pressure adjusting mechanism that is capable of adjusting an internal air pressure in at least one of the first tank, the second tank, and the third tank. The ink is fed through the circulation path according to an air pressure generated by adjustment of the air pressure and an opening and closing state of the circulation path.

Objects and advantages of the invention will become apparent from the description which follows, or may be learned by practice of the invention.

BRIEF DESCRIPTION OF THE SEVERAL VIEWS OF THE DRAWING

The accompanying drawings illustrate embodiments of the invention, and together with the general description given above and the detailed description given below, serve to explain the principles of the invention.

FIG. 4 is a table showing a circulating operation for an ink in an ink supplying mechanism according to the embodiment;

DETAILED DESCRIPTION OF THE INVENTION

Figure 1:
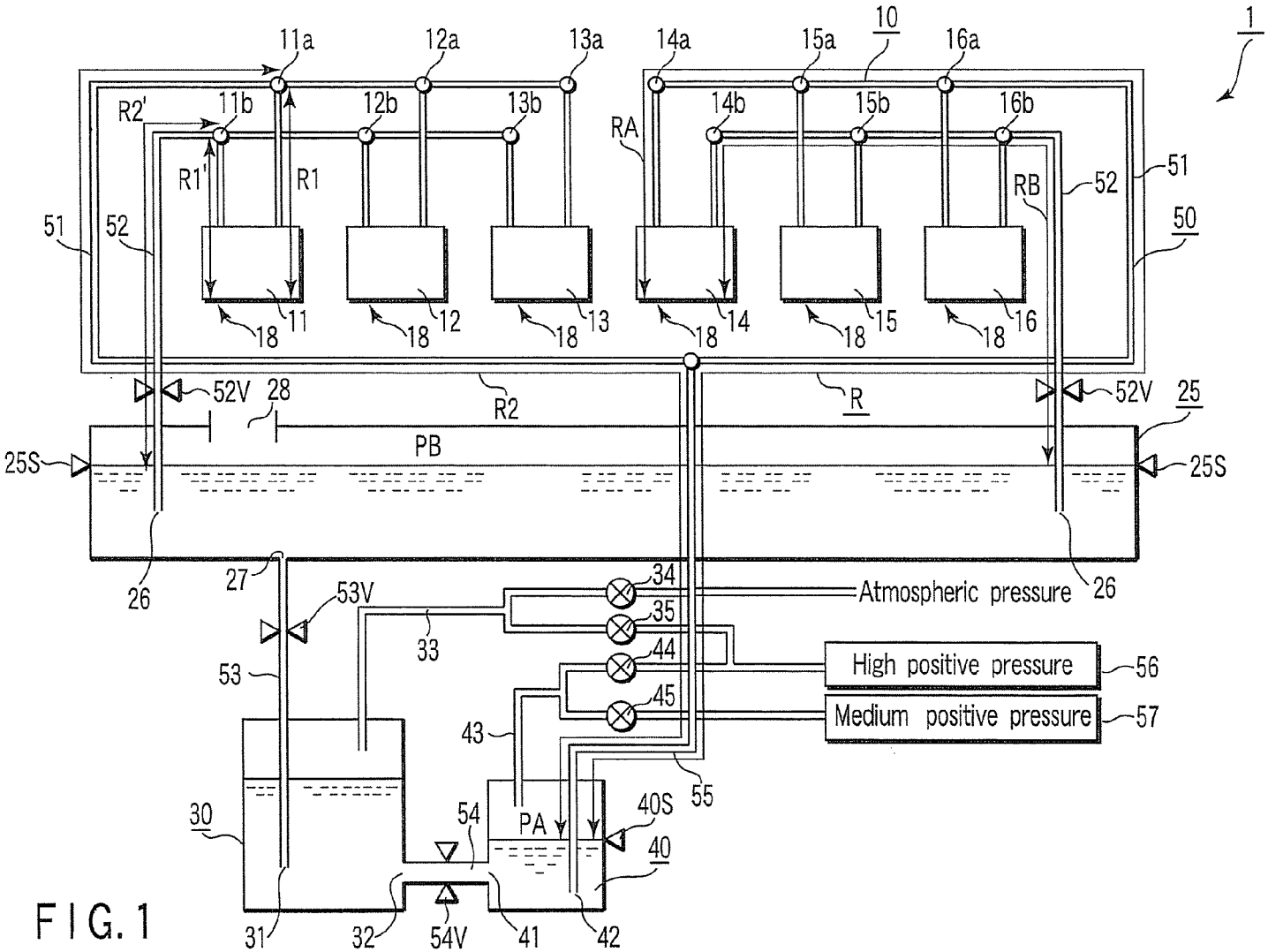
FIG. 1 is a diagram schematically showing an overall structure of an ink jet recording apparatus according to an embodiment of the invention.

An ink jet recording apparatus and an ink supplying method according to an embodiment of the invention will be hereinafter explained with reference to FIGS. 1 and 2. In the figures, components are schematically shown by enlarging, reducing, or simplifying the components as appropriate.

An ink jet recording apparatus 1 forms an image by ejecting an ink on a not-shown recording medium from nozzles 17 of ink jet heads 11 to 16 while circulating the ink. The ink jet recording apparatus 1 includes an ink supplying mechanism 10. The ink supplying mechanism 10 includes the plural (six) ink jet heads 11 to 16, a meniscus pressure tank serving as a first tank, a main tank serving as a second tank that functions as an ink supply source, a positive pressure tank serving as a third tank, and plural conduits 51 to 55 that connects the ink jet heads and the tanks. The ink supplying mechanism 10 further includes valves 52*v*, 53*v*, and 54*v* serving as opening and closing mechanisms that opens and closes the conduits 52, 53, and 54, valves 34, 35, 44, and 45 serving as air adjusting mechanisms, and air pressure sources 56 and 57. In a circulation path 50 in which the ink jet heads 11 to 16, a meniscus pressure tank 25, a main tank 30, and a positive pressure tank 40 communicate with one another through the conduits 51 to 55, opening and closing adjustment for the valves 52*v*, 53*v*, and 54*v* and air pressure adjustment are performed by a not-shown control device. Consequently, an ink is fed in a predetermined direction according to an air pressure adjusted, an opening and closing state of the valves 52*v* and the like, and a relative positional relation among the tanks. These components are described in detail below.

Figure 2:
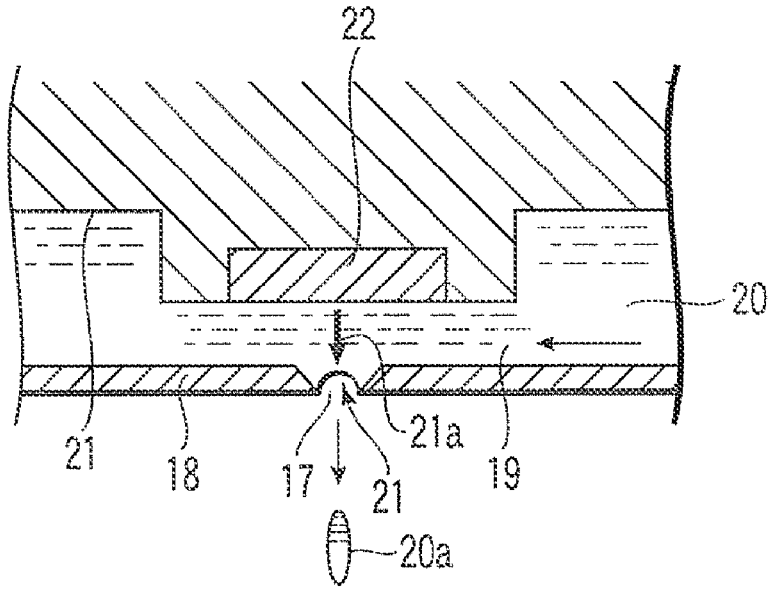
FIG. 2 is a partial sectional view showing a structure around a nozzle of an ink jet head according to the embodiment.

Each of the ink jet heads 11 to 16 shown in FIG. 2 includes an orifice plate 18 having a nozzle 17. A pressure chamber 19 is formed on the rear side of the orifice plate 18. An ink 20 circulates through the pressure chamber 19. The pressure chamber 19 is formed narrower than a circulation path that communicates with the conduits 51 and 52. An actuator 22 is provided in the pressure chamber 19 formed on the opposite surface side of the nozzle 17 in FIG. 2. In the pressure chamber 19, when the actuator 22 is driven, an ink droplet 20*a* is ejected from the nozzle 17. As the actuator 22, for example, an actuator that directly or indirectly deforms a pressure chamber using a piezoelectric element such as a PZT, an actuator that drives a diaphragm with static electricity, and an actuator that directly moves an ink with static electricity are used. However, the actuator 22 is not limited to these actuators. Each of the ink jet heads 11 to 16 has upstream ports 11*a* to 16*a* and downstream ports 11*b* to 16*b*. The upstream ports 11*a* to 16*a* of each of the ink jet heads 11 to 16 are connected to the positive pressure tank via a first conduit. The downstream ports 11*b* to 16*b* are connected to the meniscus pressure tank via second conduits. In the ink jet heads 11 to 16 constituted as described above, the ink 20 flows from the right to the left, for example, as indicated by an arrow in FIG. 2, through the pressure chamber 19.

The meniscus pressure tank 25 is arranged below the ink jet heads 11 to 16 and the liquid surface of the meniscus pressure tank 25 is located below the surface of the orifice plate 18. The meniscus pressure tank 25 is an ink tank having ink inlets 26 and an ink outlet 27. The meniscus pressure tank 25 stores an ink and has a function as a pressure source that generates energy per a unit volume, i.e., a head differential pressure PB with the surface of the orifice plate 18 as a reference. The liquid surface of the meniscus pressure tank 25 is opened to the atmospheric pressure in an upper section 28 thereof. The meniscus pressure tank 25 is formed in a size substantially the same as the width of the ink jet heads 11 to 16 and the width of a sheet serving as a not-shown print recording medium. The meniscus pressure tank 25 is connected from the ink inlets 26 at both the left and the right ends in the width direction thereof to the downstream ports 11*b* to 16*b* of the ink jet heads 11 to 16 via the second conduits 52. The second conduits 52 have valves 52*v* serving as first opening and closing mechanisms that are openable and closable by a not-shown control device. A wide space through which a print sheet (not shown) serving as a recording medium can pass is formed among the left and the right second conduits 52, the meniscus pressure tank 25, and the ink jet heads 11 to 16.

The inside of the meniscus pressure tank 25 is connected from the ink outlet 27 formed in the bottom thereof to the main tank 30, which is arranged below the meniscus pressure tank 25, via the third conduit 53. The third conduit 53 has a valve 53*v* serving as a second opening and closing mechanism that is openable and closable by the control device. A liquid surface sensor 25*s* is provided in the meniscus pressure tank 25. The height of the liquid surface of the ink in the meniscus pressure tank 25 is detected by the liquid surface sensor 25*s*. The liquid surface of the meniscus pressure tank 25 is controlled to be a predetermined height, for example, height for maintaining a negative pressure of a degree for forming an appropriate meniscus 21 shown in FIG. 2 with respect to the ink jet heads H1 to H6 on the surfaces of the orifice plates 18 on the basis of the detected result by the control device according to a method described later. For example, a meniscus pressure 21*a* is controlled to be about $\rho gh=0$ kPa to −3 kPa for the ink jet heads to perform an appropriate operation. Here, ρ is a density of the ink, g is a gravitational acceleration, and h is the height of the liquid surface viewed from the surfaces of the orifice plates 18 of the ink jet heads 11 to 16.

The main tank 30 is arranged below the ink jet heads 11 to 16. The liquid surface of the main tank 30 is located below the liquid surface of the meniscus pressure tank 25. The main tank 30 is an ink tank having an ink inlet 31 and an ink outlet 32 and has a function as an ink supply source for supplying an ink. The ink inlet 31 of the main tank 30 communicates with the bottom of the meniscus pressure tank 25 via the third conduit 53 having the valve 53*v*. The inside of the main tank 30 communicates with the inside of the positive pressure tank 40 from the ink inlet 32 via the fourth conduit 54. The fourth conduit 54 has a valve 54*v* serving as a third opening and closing mechanism that is openable and closable by the control device.

When the ink in the main tank 30 decreases, in a state in which ink leakage is prevented by closing the valves 53*v* and 54*v*, for example, a user pours and adds the ink in the main tank 30 or replaces the main tank 30 with a separate ink-filled main tank. In this way, the ink is supplied. Therefore, it is desirable that the main tank 30 has a function for residual quantity detection.

The liquid surface of the main tank 30 changes according to consumption of the ink. An air pipe 33 communicates with a space above the liquid surface of the main tank 30. The air pipe 33 is opened to the atmospheric pressure via the air valve 34 on the one hand and communicates with a high-positive-pressure air pressure source 56 via the air valve 35 on the other. It is possible to selectively open and close the air valves 34 and 35 according to the control by the control device. The air valves 34 and 35 functions as air pressure adjusting mechanisms. The high-positive-pressure air pressure source 56 includes, for example, a tank and an air pump, and has a function of supplying a predetermined air pressure. In other words, it is possible to selectively adjust an air pressure in the main tank 30 between the atmospheric pressure and a high positive pressure. The air valve 34 on the atmospheric pressure side is usually open except when the ink is supplied to the positive pressure tank 40 as described later.

The positive pressure tank 40 serving as the third tank is an ink tank having an ink inlet 41 and an ink outlet 42. The positive pressure tank 40 stores the ink and has a function as a pressure source that generates energy per a unit volume, i.e., a total value of an air pressure and a head differential pressure with the surface of the orifice plate 18 as a reference. An air pipe 43 communicates a space above the liquid surface of the positive pressure tank 40. The air pipe 43 communicates with the high-positive-pressure air pressure source 56 via the air valve 44 on the one hand and communicates with a medium-positive-pressure air pressure source 57 via the air valve 45 on the other. It is possible to selectively open and close the air valves 44 and 45 according to the control by the control device. The air valves 44 and 45 function as air pressure adjusting mechanisms. The medium-positive-pressure air pressure source 57 includes, for example, a tank and an air pump and has a function of supplying a predetermined air pressure higher than the atmospheric pressure and lower than the high positive pressure. In other words, it is possible to selectively adjust an air pressure in the positive pressure tank 40 between the high positive pressure and a medium positive pressure.

The positive pressure tank 40 includes a liquid surface sensor 40*s*. According to a result of the detection by the liquid surface sensor 40*s*, a predetermined liquid surface height is maintained by the control device according to a method described later. The ink in the positive pressure tank 40 communicates with the upstream ports 11*a* to 16*a* of the ink jet heads 11 to 16 via the fifth conduit 55. The ink is supplied from the positive pressure tank 40 to the ink jet heads 11 to 16 via the fifth conduit 55.

Figure 3:
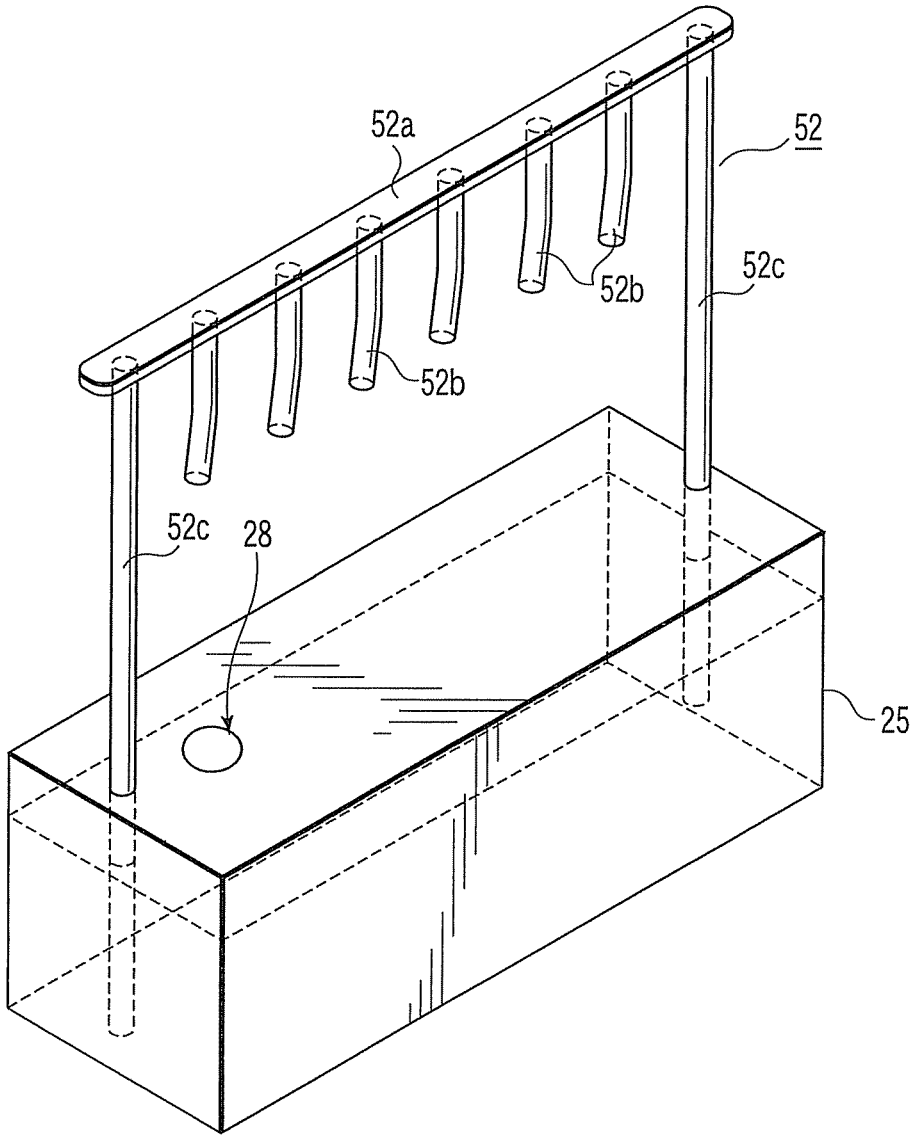
FIG. 3 is a perspective view schematically showing a structure of second conduits according to the embodiment.

A structure of the second conduits 52 will be explained with reference to FIG. 3. The second conduits 52 include three channels, namely, a channel 52*a*, a channel 52*b*, and a channel 52*c*. A channel resistance of the channel 52*a* and the channel 52*c* is R2' and a channel resistance from the channel 52*b* to the nozzle in the head unit is R1'. The channel 52*a* is made of a long flat pipe extending in the horizontal direction and collects the ink from the ink jet head. The channel 52*b* is made of a flexible cylindrical tube extending in the vertical direction and connects the channel 52*a* and the respective heads. The channel 52*c* is made of a circular pipe extending in the vertical direction and connects the channel 52*a* and the meniscus pressure tank 25.

The channel 52*a* is made of the flat pipe in order to secure a cross section thereof as large as possible to set a channel resistance as low as possible while controlling the height of a channel section thereof to prevent the air from remaining in the upper part in the channel.

On the other hand, like the channel 52*b*, the first conduit 51 and the fifth conduit 55 on the extension of the first conduit 51 are made of a flexible cylindrical tube and a joint as a whole. The fifth conduit 55 is connected to the first conduit 51 via the joint (see FIG. 1). A channel resistance from the joint to the nozzle in the head unit is R1 and a channel resistance from the joint to the positive tank is R2. In this embodiment, whereas the meniscus pressure tank, to which the channel 52*c* is connected, is located right below the heads 11 and 16, the positive pressure tank, to which the channel 51 is connected, is located relatively distant from the head. Thus, the first conduit 51 is long compared with the second conduits 52. The flat pipe of the channel 52*a* is formed with a cross section large enough for setting a channel resistance per a unit length low compared with that of the cylinder of the first conduit 51. Therefore, the channel resistance R2' is low compared with the channel resistance R2.

The channel 52*c* may be formed in the flat shape like the channel 52*a* or may be deformed as a channel including plural pipes arranged in parallel to further lower the channel resistance of the second conduits 52.

A circulating operation for the ink in the ink jet recording apparatus 1 and the ink supplying mechanism 10 according to this embodiment will be explained with reference to FIGS. 1 and 4.

It is assumed that, in a state in which the left and the right valves 52*v* are open, a pressure loss due to the valves 52*v* is negligibly small. When the valve 54*v* of the fourth conduit 54 is closed, the medium-positive-pressure air pressure source 57 is connected to the air pipe 43, and the positive pressure tank 40 is kept at the medium positive pressure, the ink is supplied to the upstream ports 11*a* to 16*a* of the ink jet heads 11 to 16 via the fifth conduit 55 and the first conduit 51.

In this state, the ink is fed from the downstream ports 11*b* to 16*b* of the ink jet heads 11 to 16 to the meniscus pressure tank 25 via the left and the right valves 52*v* and the second conduits 52. Since the meniscus pressure tank 25 is subjected to liquid surface control as described later, the ink is fed back to the main tank 30 via the valve 53*v* as appropriate. On the other hand, since the positive pressure tank 40 is also subjected to liquid surface control as described later, the ink is supplied from the main tank 30 to the positive tank 40 via the valve 54*v* as appropriate. In this way, according to a connection state of the air pipes 33 and 43 and an opening and closing state of the valves 52*v*, 53*v*, and 54*v*, the ink is fed from the positive pressure tank 40 to the meniscus pressure tank 25 via the ink jet heads 11 to 16. The ink circulates to return to the main tank 30 and the positive pressure tank 40.

In this embodiment, as shown in FIG. 1, in the first conduit 51, a channel resistance from the liquid surface of the positive pressure tank 40 to the upstream ports 11*a* to 16*a* of the ink jet heads 11 to 16 is R1, a channel resistance from the upstream ports 11*a* to 16*a* to the surfaces of the orifice plates 18 is R2, a channel resistance from the surfaces of the orifice plates 18 of the ink jet heads 11 to 16 to the downstream ports 11*b* to 16*b* is R2', and a channel resistance from the downstream ports 11*b* to 16*b* to the liquid surface of the meniscus pressure tank 25 is R1'. In FIG. 1, only the channel resistances R1, R1', R2, and R2' corresponding to the ink jet head 11 are indicated by arrows. However, the same applies to the other ink jet heads 12 to 16.

The first conduit 51, the second conduits 52, and the fifth conduit 55 are not independently separated for each of the heads and have a common conduit section. However, a channel resistance of the common conduit section is considered to be apportioned for each of the heads. A method of apportionment will be described later.

When a potential pressure in a position on the surface of the orifice plate 18 viewed from the liquid surface of the positive pressure tank 40 is PA, a potential pressure in a position on the surface of the orifice plate 18 viewed from the liquid surface of the meniscus pressure tank 25 is PB, and a total channel resistance of an ink channel network formed by the internal channel resistances of the conduits 51 to 55 and the ink jet heads 11 to 16 is R, a circulation flow rate Q is represented as Q={[(medium positive pressure)+PA]−PB}/R. (Since the position on the surface of the orifice plate 18 is higher than the liquid surface of the positive pressure tank 40 and the liquid surface of the meniscus pressure tank 25, PA and PB are negative values.)

It is possible to consider that a potential pressure on the liquid surface of the meniscus pressure tank 25 viewed from the position on the surface of the orifice plate 18 is a downstream side pressure source that generates the pressure PB. It is possible to consider that the potential pressure in the position on the surface of the orifice plate 18 viewed from the liquid surface of the positive pressure tank 40 and the air pressure of the positive pressure tank 40 form an upstream side pressure source that generates the pressure {(medium positive pressure)+PA}.

The meniscus pressure 21*a* of the respective ink jet heads 11 to 16 is a pressure obtained by dividing the pressure {(medium positive pressure)+PA} of the upstream side pressure source and the pressure PB of the downstream side pressure source by the ink channel network. A pressure distribution generated in the ink channel network depends on a flow rate distribution.

For stable operation without the wet surface of the orifice plate 18 and the air suction from the nozzle 17, the meniscus pressure 21*a* of the respective ink jet heads 11 to 16 has to be substantially fixed. When there is a circulating flow and an ink consumption quantity is sufficiently small, a flow rate on the upstream side and a flow rate on the downstream side of the respective ink jet heads 11 to 16 are substantially equal. Therefore, to control a pressure difference among the ink jet heads to be small, a ratio of a channel resistance facing the upstream side pressure source and the downstream side pressure source and a channel resistance facing the downstream side pressure source from the ink jet heads 11 to 16 via the ink channel network only has to be fixed.

On the other hand, when an ink consumption quantity is large, a balance of flow rates on the upstream side and the downstream side ejected from the nozzle 17 is lost. Thus, it is impossible to fix meniscus pressures of the ink jet heads 11 to 16 simply by fixing the ratio of the channel resistances. It is necessary to reduce the channel resistances themselves.

In general, short and large-section pipes are necessary to reduce a channel resistance. However, it is difficult to form all the pipes short and large-section because of a structural reason and in terms of easiness of ink filling and the like.

In this embodiment, a ratio of an upstream side resistance RA of the ink channel network including R1 and R2 from the liquid surface of the positive pressure tank 40 to the surface of the orifice plate 18 and a downstream side resistance RB of the ink channel network including R1' and R2' from the surface of the orifice plate 18 to the liquid surface of the meniscus pressure tank is set as, for example, 5:1 and RA>>RB. The channel resistances R1' and R2' are set to, for example, sufficiently small values with which a maximum pressure loss due to a circulating flow+an ink consumption flow rate is equal to or lower than 100 Pa. In other words, instead of uniformly setting the channel resistance R low, only the channel resistance RB on the downstream side is kept low.

An orifice pressure in this case is equal to the pressure PB of the pressure source on the downstream side if the circulating flow+the ink consumption flow rate is low. Even when the circulating flow+the ink consumption flow rate is the maximum, the orifice pressure only shifts to the positive pressure side by 100 Pa with respect to PB. Thus, if the pressure PB of the pressure source on the downstream side is set to a negative pressure with which a meniscus is formed, even if a flow rate changes, the pressure is substantially maintained.

In this embodiment, since the meniscus pressure tank 25 has a size substantially the same as the width of the ink jet heads 11 to 16 and the width of a sheet serving as a print recording medium, the second conduits are disposed in two places at the ends in a sheet width direction not affected by the passage of the sheet. Thus, in particular, it is easy to set the second conduits large-section and short. Therefore, it is possible to easily lower a channel resistance on the downstream side.

In this way, when the resistance from the respective ink jet heads 11 to 16 to the upstream side pressure source and the resistance from the respective ink jet heads 11 to 16 to the downstream side pressure source are not balanced and the pressures are set to be divided unequally on the upstream side and the downstream side, there is not only the structure advantage described above but also an advantage in terms of control.

Since it is possible to reduce a accuracy given to the pressure of the respective ink jet heads 11 to 16 by pressure accuracy of the pressure source on the high resistance side, it is possible to simplify pressure control on the high pressure side.

In the case of this embodiment, since the downstream side is opened to the atmosphere, a pressure is decided only by the height of the liquid surface and, in terms of a structure, an area is large and liquid surface height accuracy is easily improved. Thus, a highly accurate pressure source is easily obtained.

On the other hand, on the upstream side, since it is necessary to manage both an air pressure in the positive pressure tank and the height of the liquid surface of the positive pressure tank, control tends to be difficult. However, in this embodiment, since the resistance on the upstream side is set high and an influence of the upstream side is reduced, it is possible to relax the requirement for control accuracy. As a result, it is easy to perform control.

Liquid surface control for the meniscus pressure tank 25 by the control device will be explained.

When a rise of the liquid surface of the meniscus pressure tank 25 is detected by the liquid surface sensors 25*s*, it is judged by the control device whether the air pipe 33 of the main tank 30 is connected to the atmospheric pressure. When the high positive pressure is selected, the control device waits until the atmospheric pressure is selected. Moreover, after the air pipe 33 is connected to the atmospheric pressure, when a predetermined period necessary for the pressure in the main tank 30 to change to the atmospheric pressure elapses, the valve 53*v* is opened. As a result, the ink in the meniscus pressure tank 25 falls into the main tank 30.

When a potential pressure on the liquid surface of the meniscus pressure tank 25 viewed from the liquid surface of the main tank 30 is PC, a flow rate of the ink falling from the meniscus pressure tank 25 into the main tank 30 is a value obtained by dividing PC by a channel resistance of the valve 53*v* and a section around the valve 53*v*. Since, in general, the height of the liquid surface of the main tank 30 is not fixed, the value of PC changes depending on an ink residual quantity in the meniscus pressure tank 25. The flow rate of the ink falling from the meniscus pressure tank 25 into the main tank 30 also changes depending on the ink residual quantity.

The flow rate of the ink falling from the meniscus pressure tank 25 into the main tank 30 is set to be higher than a circulation flow rate even when the liquid surface of the main tank 30 is the highest. A margin should be given to this flow rate to some degrees. However, if the flow rate is too high, it is likely that turbulence is caused and the ink catches air bubbles. Therefore, for example, when the ink residual quantity in the meniscus pressure tank 25 is small and the liquid surface of the main tank 30 is the highest, i.e., when the value of PC is the smallest, it is preferable to set the flow rate of the ink to be about three times as high as the circulation flow rate. When the liquid surface of the meniscus pressure tank 25 falls below the position of the liquid surface sensors 25*s*, the valve 53*v* closes.

Liquid surface control for the positive pressure tank 40 will be explained.

When it is detected by the liquid surface sensor 40*s* that the liquid surface of the positive pressure tank 40 falls, it is judged by the control device whether the valve 53*v* is closed. When the valve 53*v* is opened, the control device waits until the valve 53*v* is closed. When the valve 53*v* is closed, the control device proceeds to the next step. The control device causes the air pipe 33 of the main tank 30 to select the high positive pressure and the high pressure is given to the main tank 30. The valve 54*v* is opened. When a potential pressure on the liquid surface of the main tank 30 viewed from the liquid surface of the positive pressure tank 40 is PD, in this case, the ink flows from the main tank 30 to the positive pressure tank 40 at a flow rate obtained by dividing {(high positive pressure)−(medium positive pressure)+PD} by a channel resistance of the valve 54*v* and a section around the valve 54*v*. As a result, the ink is supplied to the positive pressure tank 40.

Since an air pressure of the medium-positive-pressure air pressure source 57 is already adjusted to determine the circulation flow rate, a flow rate at the time of ink supply to the positive pressure tank 40 is set irrespective of the circulation flow rate by adjusting a value of an air pressure of the high-positive-pressure air pressure source 56. In general, since the height of the liquid surface of the main tank 30 is not fixed, a value of PD changes depending on an ink residual quantity in the main tank 30.

Therefore, the flow rate at the time of ink supply to the positive pressure tank 40 changes depending on the ink residual quantity in the main tank 30. Therefore, the flow rate at the time of ink supply to the positive pressure tank 40 is set to be higher than the circulation flow rate even when the liquid surface of the main tank 30 is the lowest.

A margin should be given to this flow rate to some degrees. However, if the flow rate is too high, it is likely that turbulence is caused and the ink catches air bubbles. Therefore, for example, when the ink residual quantity in the main tank 30 is small and the liquid surface of the main tank 30 is the lowest, i.e., when the value of PD is the smallest, the flow rate of the ink is set to about three times as high as the circulation flow rate. When the ink supply to the positive pressure tank 40 is finished, the valve 54*v* is closed and the atmospheric pressure is connected to the air pipe 33 of the main tank 30.

In this embodiment, it is impossible to simultaneously perform the liquid surface control for the meniscus pressure tank 25 and the liquid surface control for the positive pressure tank 40. Thus, a priority of timing when the liquid surface sensors 25*s* detect a rise of the liquid surface and timing when the liquid surface sensor 40*s* detects a fall of the liquid surface that occurs earlier is decided in advance. For example, any one of the timings that occurs earlier is given priority or, when both the timings are simultaneous, the liquid surface control for the meniscus pressure tank 25 is given priority.

When the liquid surface control for the meniscus pressure tank 25 and the liquid surface control for the positive pressure tank 40 are switched too frequently, it is likely that it is difficult to surely perform the liquid surface control because of a time loss at the time of switching. In particular, a time loss from the time when a pressure given to the main tank 30 is switched between the high positive pressure and the atmospheric pressure until the pressure actually changes to the high positive pressure or the atmospheric pressure tends to be a problem. Therefore, it is desirable to give hysteresis to the detection by the liquid surface sensors 25*s* and the liquid surface sensor 40*s* to prevent the switching of the liquid surface control by the meniscus pressure tank 25 and the liquid surface control by the positive pressure tank 40 from being performed too frequently. In this case, fluctuation in the height of the liquid surface tends to be large. However, if cross sections of the meniscus pressure tank 25 and the positive pressure tank 40 are increased, this problem does not occur.

In the explanation of the embodiment, the ink is circulated via the ink jet heads 11 to 16. During the circulation, the air pipe 43 of the positive pressure tank 40 is always connected to the medium-positive-pressure air pressure source 57 and the valves 52*v* are always open. Therefore, as long as the operation in the range described above is performed, the air valves 44 and 45 and the valves 52*v* are not always necessary.

A purge operation for wetting the surfaces of the orifice plates 18 of the ink jet heads 11 to 16 with the ink will be explained. As shown in FIG. 4, in a first purge operation, the air pipe 33 is connected to the high positive pressure and the air pipe 43 is connected to the medium positive pressure while the valve 53*v* is closed during the circulating operation, the valve 54*v* is opened, and the valves 52*v* are closed. The ink flowing out from the positive pressure tank 40 does not flow to the meniscus pressure tank 25 and overflows from the nozzle 17 because the valves 52*v* are closed. At the same time, the ink is supplied from the main tank 30 to the positive pressure tank 40. Such an operation is effective, for example, when foreign matters on the nozzle surface are removed.

As shown in FIG. 4, in a second purge operation, the valve 54*v* is closed and, at the same time, the high-positive-pressure air pressure source 56 is connected to the positive pressure tank 40. Consequently, a purge operation is performed with a higher flow rate.

In the ink supplying mechanism 10 according to this embodiment, according to the adjustment of the air pressure and the closing and opening operation of the valves 52*v*, 53*v*, and 54*v*, it is possible to circulate the ink without using a pump for feeding the ink. Therefore, the problems of chemical stability against the ink, dust, foaming, and reliability and durability due to an ink feeding pump are not caused.

The upstream side resistance RA is set to a value sufficiently large compared with the downstream side resistance RB and instead of uniformly setting the channel resistance R low, only the channel resistance RB on the downstream side is kept low. This makes it possible to reduce the accuracy given to the pressures of the respective ink jet heads 11 to 16 by the pressure accuracy of the pressure source on the high resistance side. Therefore, it is possible to simplify the pressure control on the high resistance side. In other words, in the case of this embodiment, although the control tends to be difficult on the upstream side, since an influence of the upstream side is reduced, it is possible to relax the requirement for control accuracy. As a result, it is easy to perform control.

In this embodiment, the space through which a recording medium can pass is provided between the meniscus pressure tank 25 and the ink jet heads 11 to 16 and the second conduits 52 are disposed in two places at the ends in the sheet width direction not affected by the passage of the sheet. Thus, in particular, it is easy to set the second conduits 52 large-section and short. Thus, it is easily lower the channel resistance on the downstream side by setting the second conduits 52 on the downstream side, which determine a meniscus pressure, large-section and short. Therefore, it is possible to stabilize the meniscus pressure. Moreover, since the meniscus pressure is stabilized, an ink ejection state is stabilized. As a result, it is possible to provide an ink jet recording apparatus that has less density fluctuation of the ink and high reliability.

Figure 5:
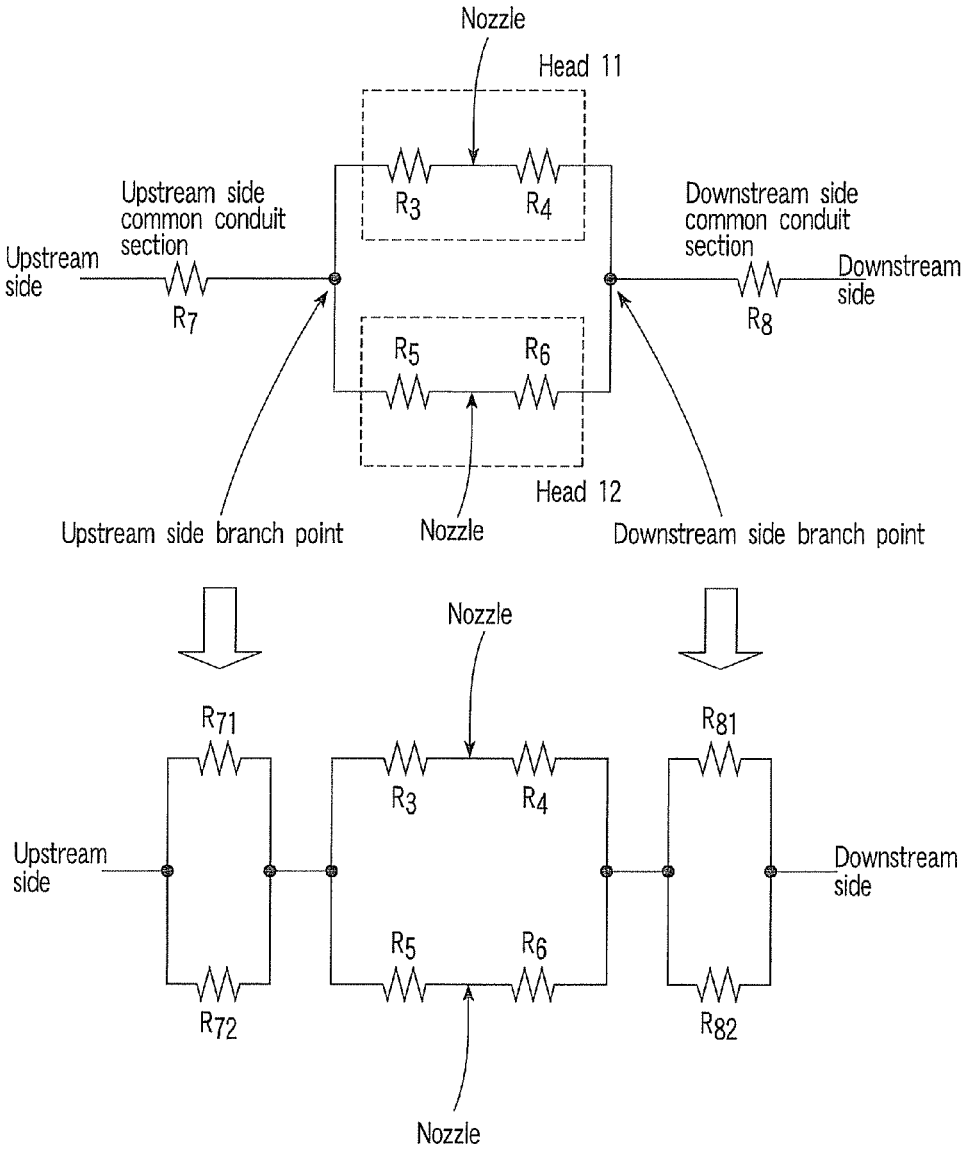
FIG. 5 is a diagram for explaining a method of apportioning a channel resistance according to the embodiment.

A method of apportioning a channel resistance of the common conduit section will be explained with reference to FIG. 5. When conduits are not separated for each of the heads and have a conduit section and a branch point common to the plural heads, it is possible to consider that the common conduit section is used by being apportioned at a ratio same as a ratio of respective channel resistances at branch destinations. Thus, the common conduit section is apportioned as parallel resistances at the ratio same as the ratio of the respective channel resistances at the branch destinations to calculate a channel resistance for each of the heads.

A method of apportioning the common conduit section to the parallel resistances will be explained using an equivalent circuit diagram.

When channel resistances from a nozzle of a head 1 to branch points on the upstream side and the downstream side are R3 and R4, respectively, channel resistances from a nozzle of a head 2 to branch points on the upstream side and the downstream side are R5 and R6, respectively, a channel resistance of a common conduit section on the upstream side is R7, and a channel resistance of a common conduit section on the downstream side is R8, the channel resistance R7 is apportioned to parallel channel resistances R71 and R72 and the channel resistance R8 is apportioned to parallel channel resistances R81 and R82.

A method of apportionment only has to be set such that the following equations hold.

$$R71:R72=R81:R82=(R3+R4)(R5+R6)$$

$$1/R7=1/R71+1/R72$$

$$1/R8=1/R81+1/R82$$

In this case, R71:R81=R72:R82=R7:R8.

It is considered that a channel resistance upstream from the nozzle of the head 1 is (R71+R3), a channel resistance downstream from the nozzle of the head 1 is (R81+R4), a channel resistance upstream from the nozzle of the head 2 is (R72+R5), and a channel resistance downstream from the nozzle of the head 2 is (R82+R6).

The invention is not limited to the embodiment. It goes without saying that, in carrying out the invention, elements of the invention such as specific shapes of the components may be changed in various ways without departing from the spirit of the invention. For example, in the example described in the embodiment, as shown in FIG. 2, the ink jet heads 11 to 16 eject the ink 20 while circulating the ink 20 via the pressure chamber 19 for the ink. However, an ink jet head is not limited to such ink jet heads. The ink jet head may be a head that has a pressure chamber and a nozzle at branch destinations from a circulation path or may be a head block that forms an independent head at a branch destination from a circulation path.

Figure 6:
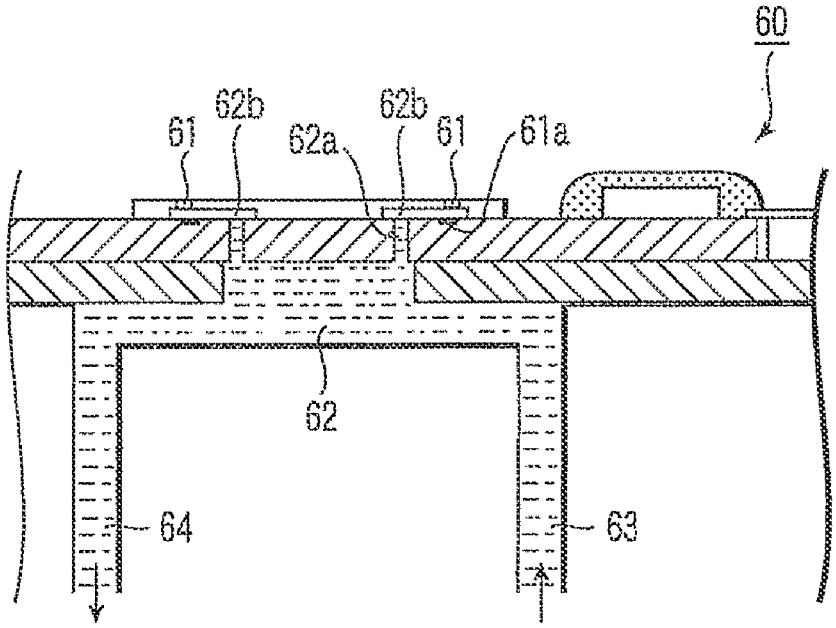
FIG. 6 is a partial sectional view showing a structure around a nozzle of an ink jet head according to a modification of the embodiment.

For example, as in an ink jet head 60 shown in FIG. 6, it is also possible to apply a method of circulating and supplying an ink to an ink storing unit 62. The ink jet head 60 includes plural nozzles 61, heat generating elements 61*a* formed to be opposed to the nozzles 61, the ink storing unit 62, and channels 63 and 64 that communicate with an upstream side and a downstream side of the ink storing unit 62. When the channels 63 and 64 are connected to the first conduit 51 and the second conduit 52 in the ink supplying mechanism 10 according to the embodiment, functions and effects same as those in the embodiment are obtained. In this form, pressure chambers 62*b* and the nozzles 61, in which meniscuses are formed, are provided via slits 62*a* to be spaced apart from the ink storing unit 62. It can be considered that the ink storing unit 62 is a branch point of the pressure chambers 62*b* and the nozzles 61 via an ink circulating section and the slits 62*a*. When the ink is circulated to such an ink jet head 60, if the heights of the ink storing unit 62 and the surface of the nozzles 61 are hardly different, a meniscus pressure at the branch point and a meniscus pressure in the nozzle are substantially equal when the ink is not ejected. Therefore, it may be considered that an ink pressure in the ink storing unit 62 is the meniscus pressure in the nozzles. When the ink is ejected, it may be considered that the meniscus pressure in the nozzles falls by a pressure obtained by multiplying an ejection flow rate by a channel resistance from the branch point to the nozzles.

Moreover, a print head used for this ink jet apparatus may be a type that branches to an actuator and nozzles from the middle of a circulation path via a filter. In this case, it may be considered that, in a state in which the ink is not ejected, a pressure in the nozzles is identical with a pressure in a section where a primary side of the filter is in contact with the circulation path. It may be considered that, when the ink is ejected, the pressure in the nozzles falls by a pressure obtained by multiplying an ejection flow rate by a channel resistance from the primary side of the filter to the nozzles.

As the actuator 22, other than that described in the embodiment, for example, actuators of a piezoelectric type, a piezoelectric share mode type, a thermal ink jet type, and the like are also applicable.

When there are plural nozzle openings in the surface of an orifice plate and heights of the openings are different, it may be considered that an average of the heights of the nozzles is the height of the surface of the orifice plate as long as a difference in pressures near the nozzle due to the difference in heights does not exceed a range of proper pressures near the nozzle. In this case, when a direction of an ink circulation flow in a head is set in a direction from a section near a low nozzle to a section near a high nozzle, it is possible to reduce the difference in pressures near the nozzle due to the difference in heights. Thus, the direction of the ink circulation flow may be set in this way.

Arrangements, numbers, and the like of the air valves 34, 35, 44, and 45 serving as the air pressure adjusting mechanisms and the valves 52*v*, 53*v*, and 54*v* serving as the opening and closing mechanisms are not limited to those in the embodiment. The arrangements, numbers, and the like may be changed as appropriate without departing from the spirit of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the inventive as defined by the appended claims and equivalents thereof.

What is claimed is:

1. An ink jet recording apparatus comprising:

an ink jet head having a pressure chamber opposed to a nozzle, an upstream port that communicates with the pressure chamber, and a downstream port;

a first tank that communicates with the ink jet head via the downstream port and stores ink, the first tank opening to atmospheric pressure;

a second tank that communicates with the first tank and stores the ink;

a third tank that communicates with the ink jet head via the upstream port and communicates with the second tank and stores the ink;

an opening and closing mechanism that is capable of opening and closing a circulation path that the ink flows out from the ink jet head, passes through the first tank, the second tank, and the third tank in that order, and flows in the ink jet head; and an air pressure adjusting mechanism that is capable of adjusting an internal air pressure in at least one of the second tank and the third tank to make the ink circulate in the order of the downstream port, the first tank, the second tank, and the third tank, and the upstream port by adjustment of the air pressure and an opening and closing state of the circulation path to give meniscus pressure to the head.

2. An ink jet recording apparatus according to claim 1, wherein a liquid surface of the ink in the first tank is located below a surface of an orifice plate in which the nozzle of the head is formed, a liquid surface of the ink in the second tank is located below the liquid surface of the ink in the first tank, the air pressure adjusting mechanism is provided in the second tank and the third tank, and the opening and closing mechanism includes a first opening and closing mechanism provided between the downstream port of the ink jet head and the first tank, a second opening and closing mechanism provided between the first tank and the second tank, and a third opening and closing mechanism provided between the second tank and the third tank.

3. An ink jet recording apparatus according to claim 1, further comprising:

a liquid surface detecting device that detects a liquid surface of the ink in at least one of the first tank, the second tank, and the third tank; and a control device that controls operations of the air pressure adjusting mechanism and the opening and closing mechanism according to a result of the detection of the liquid surface.

4. An ink jet recording apparatus according to claim 3, wherein, in a state in which a positive air pressure is given to the liquid surface of the ink in the third tank, an inside of the first tank is opened to an atmosphere, and the ink flows from the third tank to the first tank, when the liquid surface of the first tank rises to a position higher than a predetermined height, the second opening and closing mechanism is brought into an open state and the ink in the first tank is supplied to the second tank provided below the first tank, and when the liquid surface of the third tank falls to a position lower than a predetermined height, an air pressure higher than an air pressure inside the third tank is give to the second tank, the third opening and closing mechanism is brought into an open state, and the ink is supplied to the third tank.

5. An ink jet recording apparatus according to claim 4, wherein a downstream side channel resistance from a neighborhood of the nozzle of the ink jet head to the liquid surface of the first tank is set lower than an upstream side channel resistance from the liquid surface of the third tank to the neighborhood of the nozzle of the ink jet head.

6. An ink jet recording apparatus according to claim 1, wherein the first tank is connected to a downstream side of the ink jet head from both ends in a width direction, which is a direction perpendicular to a recording medium feeding direction, via a conduit, and a recording medium is capable of passing through a space among the ink jet head, the first tank, and the conduit.

7. An ink jet recording apparatus according to claim 1, wherein a downstream side channel resistance from a neighborhood of the nozzle of the ink jet head to the liquid surface of the first tank is set lower than an upstream side channel resistance from the liquid surface of the third tank to a neighborhood of the nozzle of the ink jet head.

8. An ink supplying mechanism comprising:

an ink jet head having a pressure chamber opposed to a nozzle, an upstream port that communicates with the pressure chamber, and a downstream port;

a first tank that communicates with the ink jet head via the downstream port and stores ink, the first tank opening to atmospheric pressure;

a second tank that communicates with the first tank and stores the ink;

a third tank that communicates with the ink jet head via the upstream port and communicates with the second tank and stores the ink;

an opening and closing mechanism that is capable of opening and closing a circulation path that the ink flows out from the ink jet head, passes through the first tank, the second tank, and the third tank in that order, and flows in the ink jet head; and an air pressure adjusting mechanism that is capable of adjusting an internal air pressure in at least one of the second tank and the third tank to make the ink circulate in the order of the downstream port, the first tank, the second tank, and the third tank, and the upstream port by adjustment of the air pressure and an opening and closing state of the circulation path to give meniscus pressure to the head.

9. An ink supplying method comprising:

adjusting an opening and closing state of a circulation path that connects (i) an ink jet head having a pressure chamber opposed to a nozzle, an upstream port that communicates with the pressure chamber, and a downstream port, (ii) a first tank that communicates with the ink jet head via the downstream port and stores ink, the first tank opening to atmospheric pressure, (iii) a second tank that communicates with the first tank and stores the ink, and (iv) a third tank that communicates with the ink jet head via the upstream port and communicates with the second tank and stores the ink; and adjusting an internal air pressure of at least one of the second tank and the third tank to make the ink circulate in the order of the downstream port, the first tank, the second tank, and the third tank, and the upstream port by adjustment of the air pressure and an opening and closing state of the circulation path to give meniscus pressure to the head.

10. An ink supplying method according to claim 9, further comprising:

detecting a liquid surface of the ink in at least one of the first tank, the second tank, and the third tank; and adjusting the air pressure and the opening and closing state according to a result of the detection of the liquid surface.

11. An ink supplying method according to claim 10, wherein, in a state in which a positive air pressure is given to the liquid surface of the ink in the third tank, an inside of the first tank is opened to an atmosphere, and the ink flows from the third tank to the first tank, the opening and closing state is adjusted such that when the liquid surface of the first tank rises to a position higher than a predetermined height, the opening and closing state is set to supply the ink in the first tank to the second tank provided below the first tank, and that when the liquid surface of the third tank falls to a position lower than a predetermined height, an air pressure higher than an air pressure inside the third tank is given to the second tank and the ink in the second tank is supplied to the ink to the third tank.

* * * * *